US008900035B2

(12) United States Patent
Hofmann et al.

(10) Patent No.: US 8,900,035 B2
(45) Date of Patent: Dec. 2, 2014

(54) METHOD AND DEVICE FOR GRINDING A CONTINUOUS CASTING PRODUCT

(75) Inventors: Karl Robert Hofmann, Netphen (DE); Guenter Schiller, Schwindegg (DE); Andreas Leukel, Olpe (DE)

(73) Assignee: SMS Logistiksysteme GmbH, Netphen (DE)

( * ) Notice: Subject to any disclaimer, the term of this patent is extended or adjusted under 35 U.S.C. 154(b) by 339 days.

(21) Appl. No.: 13/132,059

(22) PCT Filed: Mar. 19, 2010

(86) PCT No.: PCT/EP2010/001731
§ 371 (c)(1),
(2), (4) Date: Jul. 25, 2011

(87) PCT Pub. No.: WO2010/105839
PCT Pub. Date: Sep. 23, 2010

(65) Prior Publication Data

US 2011/0281505 A1 Nov. 17, 2011

(30) Foreign Application Priority Data

Mar. 19, 2009 (DE) ..... 10 2009 013 481

(51) Int. Cl.
*B24B 7/00* (2006.01)
*B22D 11/12* (2006.01)
*B24B 27/04* (2006.01)

(52) U.S. Cl.
CPC ..... *B24B 7/005* (2013.01); *B22D 11/12* (2013.01); *B24B 27/04* (2013.01)
USPC ..... 451/28; 451/231; 451/414

(58) Field of Classification Search
CPC ..... B22D 11/12; B24B 27/04; B24B 27/005; B24B 27/10; B24B 27/17; B24B 27/22; B24B 27/222; B24B 27/224; B24B 27/24; B24B 27/241; B24B 27/244; B24B 27/247; B27B 7/00
USPC ..... 451/11, 137, 231, 232, 278, 279, 28, 451/334, 387, 405, 41, 412, 414
See application file for complete search history.

(56) References Cited

U.S. PATENT DOCUMENTS

| | | | | | |
|---|---|---|---|---|---|
| 324,641 | A | * | 8/1885 | Berry | 451/194 |
| 359,533 | A | * | 3/1887 | Convers | 451/213 |
| 455,418 | A | * | 7/1891 | Sweeney et al. | 451/213 |
| 634,225 | A | * | 10/1899 | Wilson | 269/64 |
| 1,012,227 | A | * | 12/1911 | Stioh | 451/160 |
| 1,183,947 | A | * | 5/1916 | Bradley | 451/260 |
| 1,991,958 | A | * | 2/1935 | Romaine | 451/244 |
| 2,572,220 | A | * | 10/1951 | Vidales | 451/405 |
| 2,738,625 | A | * | 3/1956 | Strnad | 451/160 |

(Continued)

FOREIGN PATENT DOCUMENTS

EP 053274 B 12/1984

*Primary Examiner* — Lee D Wilson
*Assistant Examiner* — Tyrone V Hall, Jr.
(74) *Attorney, Agent, or Firm* — Andrew Wilford

(57) ABSTRACT

A cast slab having a pair of wide, substantially planar, and opposite side faces and a pair of narrow opposite edge faces, is ground by first orienting the slab with the side and edge faces vertical. Then grinding tools are pressed oppositely and horizontally against opposite wide faces, with the grinders throwing the chips downward. The tools and slab are relatively vertically displaced for the grinding.

14 Claims, 6 Drawing Sheets

(56) References Cited

U.S. PATENT DOCUMENTS

| | | | | | |
|---|---|---|---|---|---|
| 2,787,872 | A * | 4/1957 | Parker | 451/278 |
| 2,865,149 | A * | 12/1958 | Soave | 451/365 |
| 3,178,859 | A * | 4/1965 | Schaar | 451/137 |
| 3,492,918 | A * | 2/1970 | Michelson | 409/132 |
| 4,060,938 | A * | 12/1977 | Barron, Sr. | 451/260 |
| 4,594,814 | A * | 6/1986 | Olszewski et al. | 451/44 |
| 5,148,632 | A * | 9/1992 | Adler et al. | 451/232 |
| 5,613,898 | A * | 3/1997 | Lumen | 451/190 |
| 6,142,856 | A * | 11/2000 | Romhild | 451/279 |
| 6,231,429 | B1 * | 5/2001 | Lisec | 451/44 |
| 7,134,936 | B2 * | 11/2006 | Gariglio | 451/11 |
| 7,987,608 | B2 * | 8/2011 | Rowe | 33/370 |
| 2008/0318496 | A1 * | 12/2008 | Tanikella et al. | 451/41 |

* cited by examiner

Fig.1 - Prior art

METHOD AND DEVICE FOR GRINDING A CONTINUOUS CASTING PRODUCT

CROSS REFERENCE TO RELATED APPLICATIONS

This application is the US-national stage of PCT application PCT/EP2010/001731, filed 19 Mar. 2010, published 23 Sep. 2010 as WO2010/105839, and claiming the priority of German patent application 102009013481.6 itself filed 19 Mar. 2009.

FIELD OF THE INVENTION

The invention relates to a method of grinding a continuously cast product, in particular a slab, where the continuously cast product is of rectangular cross section with two wide side faces lying opposite one another and two narrow edge faces lying opposite one another, at least the wide side faces being subjected to a surface treatment by at least one grinding tool. Furthermore, the invention relates to an apparatus for grinding a continuously cast product.

BACKGROUND OF THE INVENTION

Continuously cast products, in particular slabs, are subjected to surface treatment by grinding after continuous casting in order to obtain an adequate quality during the further processing of the product. In the grinding of continuously cast slabs, the slab is usually longitudinally reciprocated under a grinder (grinding unit). At the end of each reversing movement, the grinder is transversely indexed until the entire slab surface has been ground.

During grinding, the slab is supported lying on its long broad side on a grinding table.

A prior-art generic apparatus for grinding slabs is shown in FIG. 1. It is similar to that described in EP 053274.

So-called HP grinding (High-Pressure Grinding) of the slab 1 is carried out on the apparatus shown in FIG. 1. The apparatus has a grinding table 13 as well as a grinder 9 with a drive motor 10 and a grinding wheel 6. The slab 1 has in the known manner two wide side faces 2 and 3 (long sides) and two narrow edge faces 4 and 5 (short sides). It rests with one of its wide side faces 3 on the grinding table 13. During grinding of the surface of the slab, the grinding table 13 reciprocates longitudinally under the grinder 9 in a direction perpendicular to the drawing plane. The grinding wheel 6 is pressed against the surface of the slab 1 by a grinding pressure cylinder 14. The slab 1 is thus moved back and forth in the longitudinal direction relative to the grinder 9 by the grinding table 13. With each reversing movement, the grinder 9 is transversely indexed by a feed cylinder 15, until the surface of the slab has been completely ground.

The disadvantage is that, positioned with the broad side on the grinding table 13, the slab 1 has a minimal areal moment of inertia relative to an axis that is horizontal and transverse to the longitudinal axis of the slab. Accordingly, resistance to bending about this axis is minimal. In particular during grinding of a slab at a high temperature (for example up to 800° C.), there is therefore a danger of bending. The grinding table 13 is therefore provided at predetermined spacings along the longitudinal axis of the slab 1 with stops 16 are intended to minimize bending of the slab. The number of the stops 16 is selected to be correspondingly high for this purpose. However, this has the negative result of a relatively massive and heavy construction of the grinding table.

Slabs at average temperatures (in the range of 450° C., for example) bend upward due to the higher temperatures at their lower horizontal main side at the ends of the slab. This leads in a disadvantageous manner to the slab tending toward undesirable vibrations during grinding with the positioning shown during grinding. In this case, the slab 1 rests above all on central supports 13.

Slabs cooled to workshop temperature are therefore also as a rule not planar on their broad sides.

Another problem lies in that considerable deposit of grinding chips on the apparatus can occur when flying chips are not contained optimally during grinding. Therefore a relatively high maintenance expenditure is necessary with solutions previously known in order to keep the apparatus in optimal use condition.

OBJECT OF THE INVENTION

The object of the invention is therefore to create a method and an associated apparatus with which it is possible to minimize the bending of the continuously cast product, in particular of the slabs, using a relatively light construction. The object is also to optimize the quality of the grinding processing. Furthermore, the object is to ensure that the grinding of the continuously cast product can be carried out efficiently and quickly so the grinding processing can be cost-effective. Furthermore, the aim is to design the method and the apparatus such that a removal of the grinding chips can be carried out in an improved manner. This is designed in particular to reduce the deposit of chips on the apparatus.

SUMMARY OF THE INVENTION

This object is attained by the invention in that during grinding of a wide side face of the continuously cast product, the continuously cast product is positioned by a seat such that a perpendicular to the wide side face of the continuously cast product forms an acute angle greater than zero degrees with the vertical.

The angle between the perpendicular and the vertical is preferably between 30° and 90°. One embodiment uses an angle between 40° and 75°. A preferred embodiment provides that the angle between the perpendicular and the vertical is 90° (vertically oriented slab).

A further development provides that at least one wide side face as well as one narrow edge face are ground by the grinding tool(s) in one position of the continuously cast product on the seat. A separate grinding unit for grinding the short or narrow side can thus be omitted.

In the case of a vertically oriented slab in a particularly advantageous manner the two wide side faces of the continuously cast product lying opposite one another are ground simultaneously by at least two grinding tools. The continuously ground product can thus be suspended by a seat in the form of a holding frame during grinding.

The wide side face of the continuously cast product is is usually at least twice as long as the narrow edge face, often even much more than twice as long.

The proposed apparatus for grinding a continuously cast product has at least one grinder with at least one grinding tool for grinding at least one wide side face of the continuously cast product and is characterized in that the apparatus comprises at least one seat that positions the continuously cast product during grinding in such a manner that a perpendicular to the wide side face of the continuously cast product forms an acute angle greater than 0° with the vertical, preferably an angle between 30° and 90°.

The apparatus can also have two grinders with respective grinding tools that simultaneously process the two opposite wide side faces of the continually cast product.

The seat for the continuously cast product can have a mounting surface for a wide side face of the continuously cast product and a mounting surface for a narrow edge face of the continuously cast product.

Optionally, the seat comprises a holding frame that can suspend the continually cast product.

The invention is based on the discovery that the moment of inertia of the continuously cast product, in particular the slab, about a horizontal transverse axis and thus the resistance to bending increases when the continuously cast product is placed on its narrow side tilted about a longitudinal axis. By reducing the number of stops necessary for the grinding table, the weight of the grinding table can therefore be advantageously reduced.

With the tilted arrangement of the continuously cast product during grinding, furthermore, flying chips are deflected more directly into the chip collection box than in the case of horizontal support, i.e. optimally. The danger of deposits is thus reduced. The chip collection box can therefore be smaller in an is advantageous manner. Thus advantageously flying sparks are oriented in a targeted manner to the floor and a simpler chip collection box can be used.

In order to reduce the cost for manufacturing the apparatus and in particular for the grinding table and the chip collection box, therefore the object is to increase the moment of inertia of the continuously cast product during the grinding processing, which can be achieved with the cited approach and embodiment respectively according to the invention.

Accordingly, bending of the continuously cast product is less than with previously known solutions.

When during grinding from workshop temperature to high temperatures grinding is carried out with slab positioned in a tilted manner according to the invention, from a certain angle, the preferred range of which is given, due to its high dead weight, the slab lies securely on its respective narrow side so that only a few seats are necessary.

Another advantage of the proposed solution, in particular with higher slab temperatures, is that the broad sides of the slab can be inspected directly at close range from the side.

BRIEF DESCRIPTION OF THE DRAWING

The drawing shows the prior and several embodiments of the invention. Therein.

SPECIFIC DESCRIPTION OF THE INVENTION

Figure 1:
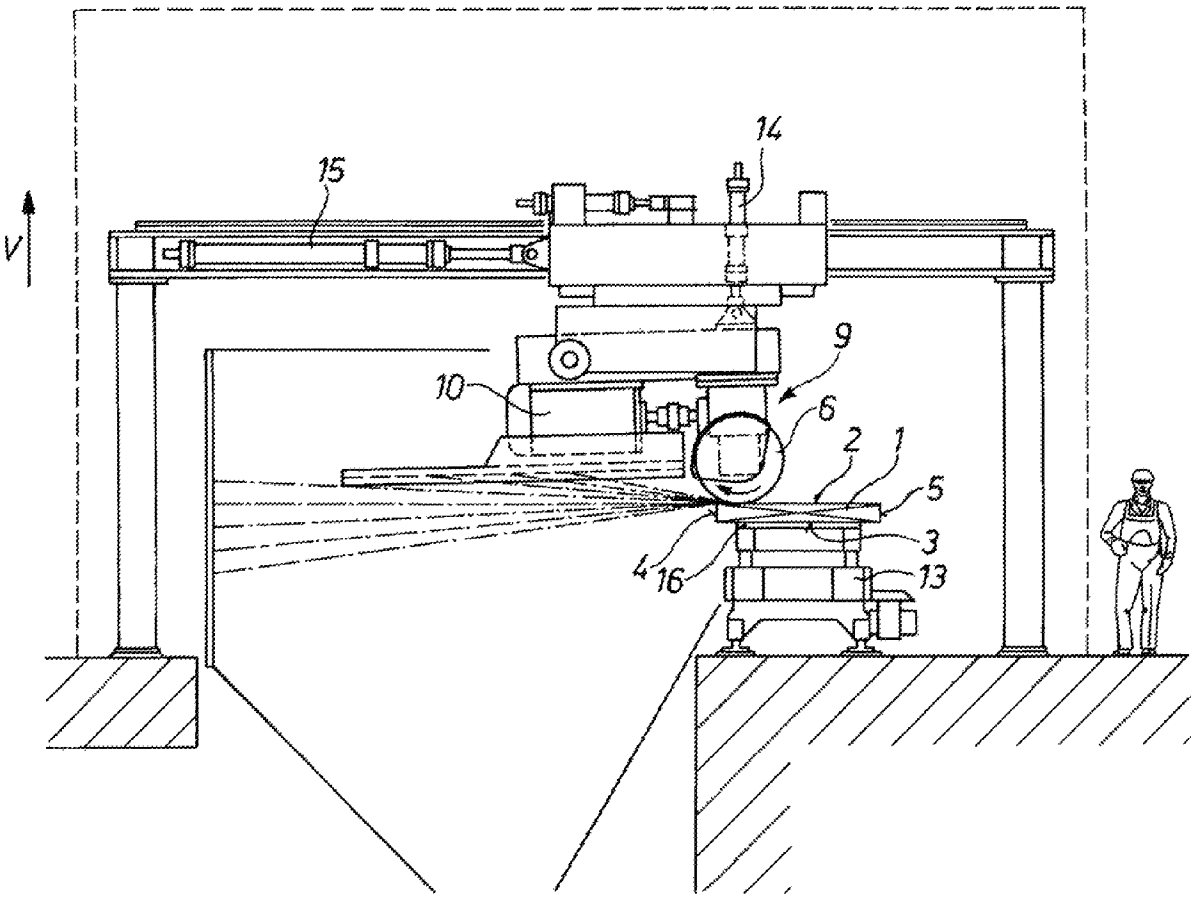
FIG. 1 shows a prior-art apparatus for grinding a continuously cast slab.
Figure 2:
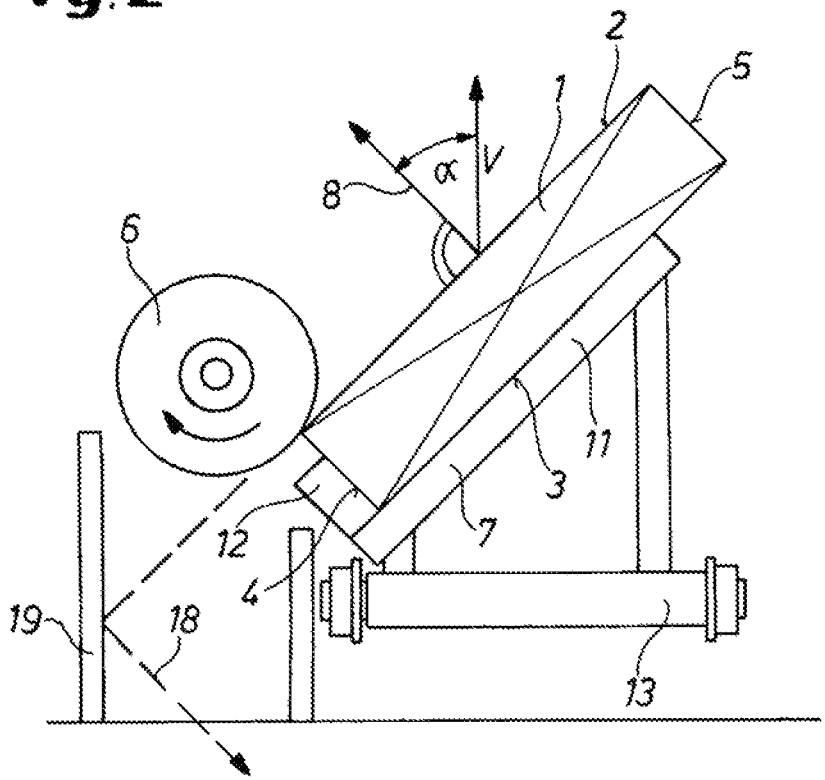
FIG. 2 diagrammatically shows an apparatus for grinding a continuously cast slab according to a first embodiment of the invention.

FIG. 2 diagrammatically illustrates an apparatus for grinding a slab 1 according to the invention. The slab 1 has a rectangular cross section shown in FIG. 2 and extends with its longitudinal axis in a direction perpendicular to the drawing plane. The slab 1 accordingly has two wide side faces 2 and 3 and two narrow edge faces 4 and 5. The wide side faces 2 and 3 are usually at least twice as wide as the narrow edge faces 4, 5, normally much longer.

The surface of the slab must be processed by grinding in order ultimately to be able to produce a product with sufficient quality from the slab by a subsequent rolling process. To this end, a grinder is provided of which only the grinding wheel 6 is shown in FIG. 2. An arrow indicates the direction of rotation of the grinding wheel 6 during the operation.

In order to increase the areal moment of inertia about a horizontal axis running transversely to the longitudinal direction of the slab and consequently to minimize bending of the slab 1 during grinding, during grinding of the upper wide side face 2 (the same applies after turning of the slab during grinding of the lower wide side face 3) of the slab 1, is positioned by a seat 7 such that a perpendicular 8 to the wide side face 2 of the slab 1 forms with the vertical V (i.e. seen in the direction of gravity) an acute angle $\alpha$. This angle is greater than zero degrees. Preferably it is 30° or more.

In this position, the grinding process known per se is carried out, i.e. the grinding table 13 oscillates back and forth in the direction of the longitudinal axis of the slab 1 (thus in the direction perpendicular to the drawing plane), while the grinding wheel 6 with each stroke or double stroke of the grinding table 13 is advanced by a certain amount transversely to the width direction of the slab 1.

To hold the slab 1, the seat 7 in this case has a mounting face 11 formed by struts spaced apart from one another for the wide side face 3 and a mounting face 12 for the narrow edge face 4.

The direction of rotation of the grinding wheel 6 causes grinding chips to be deflected downward on the tilted slab surface and to be guided into a chip collection box under the apparatus. The direction of flying chips is indicated by broken line 18. As can be seen, a deflector plate 19 can be provided in order to redirect the flying chips 18.

The slab 1 processed in this manner can be a hot slab. The proposal according to the invention comes into its own in particular due to the higher workpiece temperature, since bending of the slab is a particularly relevant subject in this case.

Figure 3:
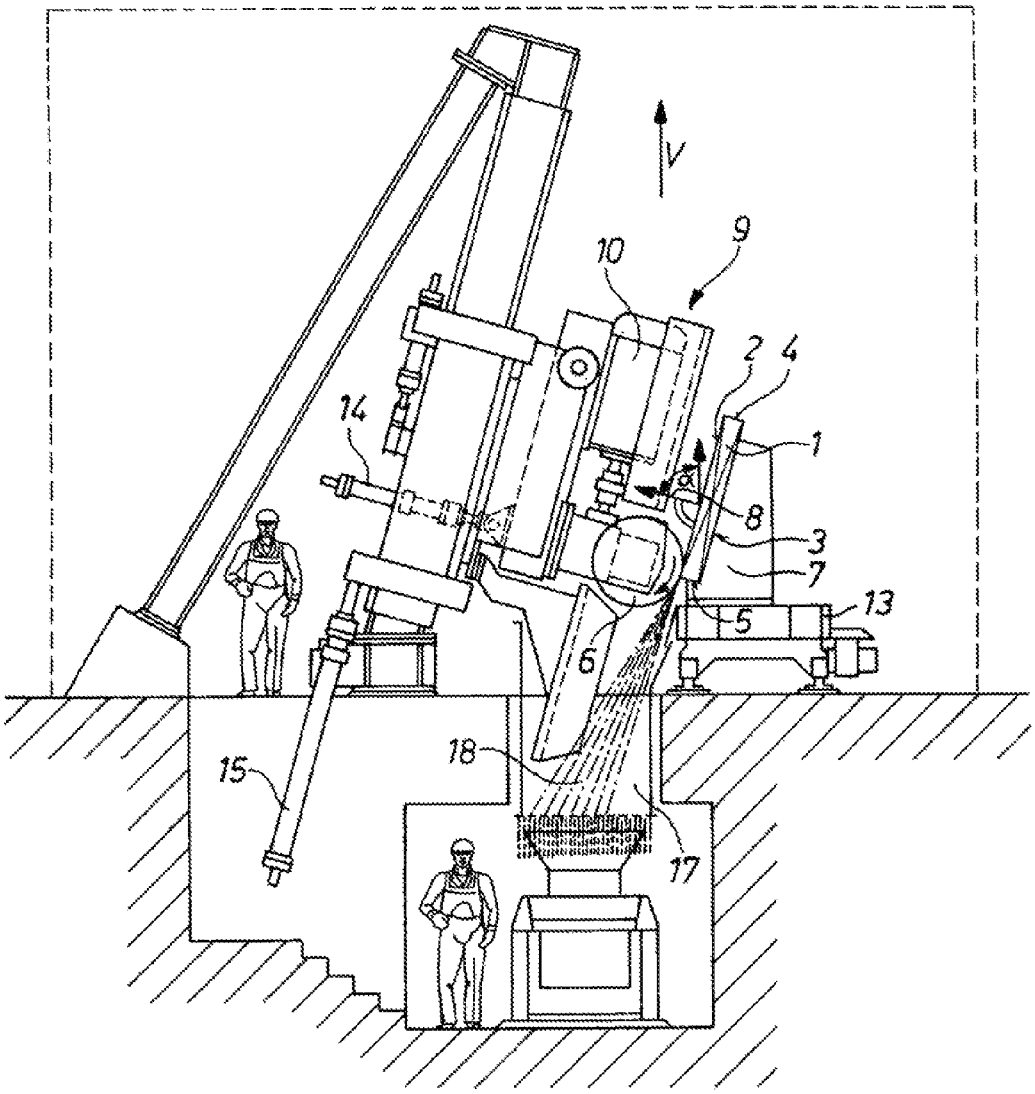
FIG. 3 shows an apparatus for grinding a continuously cast slab according to a second embodiment of the invention.

FIG. 3 shows a concrete embodiment of an apparatus for grinding a slab 1, in which different apparatuses are also shown that were omitted according to the diagrammatic illustration according to FIG. 2. In principle the same applies here as was the regarding FIG. 2. However, here the slab 1 is positioned tilted somewhat more than is the case in FIG. 2. Here the perpendicular 8 forms an angle $\alpha$ of approximately 75° with the vertical V.

The grinder 9 is shown to have a drive motor 10 for rotating the grinding wheel 6. During processing of the slab 1, the grinding wheel 6 is advanced or pressed perpendicular to the surface of the slab by a grinding pressure cylinder 14. Stepwise indexing of the grinding wheel 6 across the width of the wide side face 2 of the slab 1 is accomplished by a feed cylinder 15. A chip collection box 17 is arranged below the apparatus.

Figure 4:
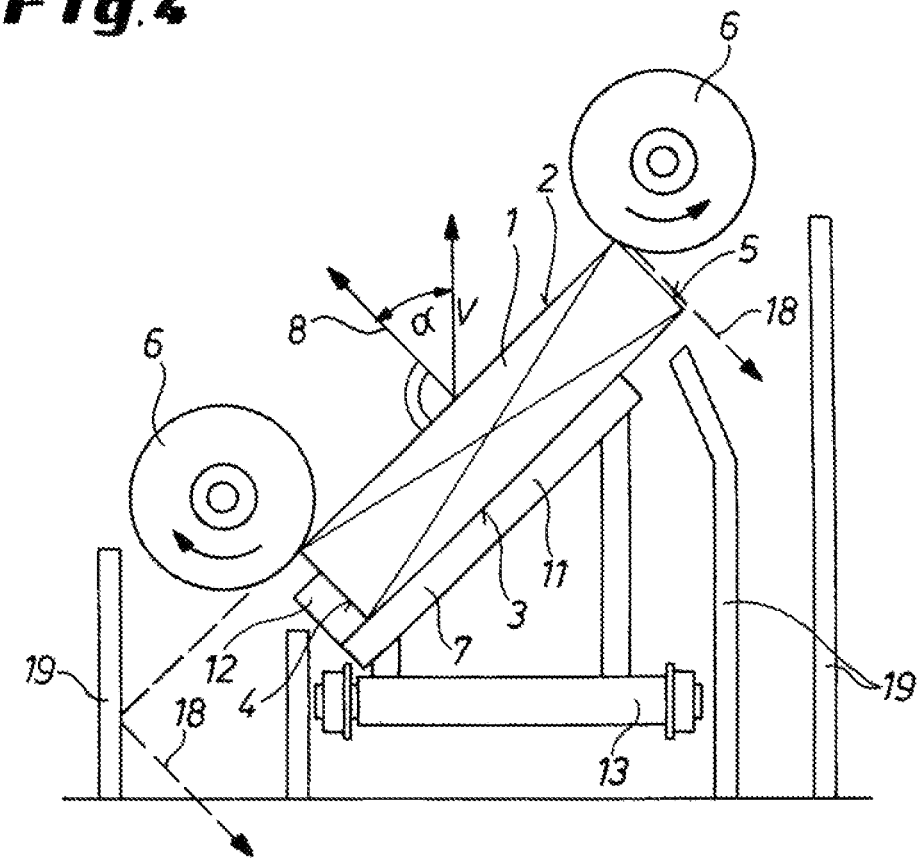
FIG. 4 shows the apparatus according to FIG. 2 using another procedure according to the invention.

FIG. 4 shows a variation of the solution according to FIG. 2.

Usually, both the wide side faces of the slab as well as the narrow edge faces are ground. As a rule, two separate grinders are used for this. The wide side face is ground with a powerful main unit. An auxiliary unit with lower power can be installed for the narrow edge face.

Expanding the function of the main unit creates the possibility of also grinding the narrow edge face with the main unit. This is shown in FIG. 4.

The grinding wheel 6 is shown here in two different positions. In the lower position, the grinding of the wide side face 2 of the slab takes place as explained with reference to FIG. 2. However, after grinding of the wide side face 2, the grinding wheel 6 is also guided across the narrow edge face 5 here, in order to grind it in the shown position of the slab 1 in the seat 7. This is indicated by the upper position of the grinding wheel 6. In order for it to be possible to favorably guide the grinding chips downward into the chip collection box (not shown) in this case too, the grinding of the narrow edge face 5 is done with opposite rotation of the grinding wheel 6 (see arrow). To guide the chips, deflector plates 19 are also provided here.

The main unit is modified here such that grinding of the wide side face as well as grinding of the narrow edge face are possible. A separate auxiliary unit can thus be omitted. For this purpose, both directions of movement of the grinding unit must be associated with a respective grinding pressure control.

Figure 5:
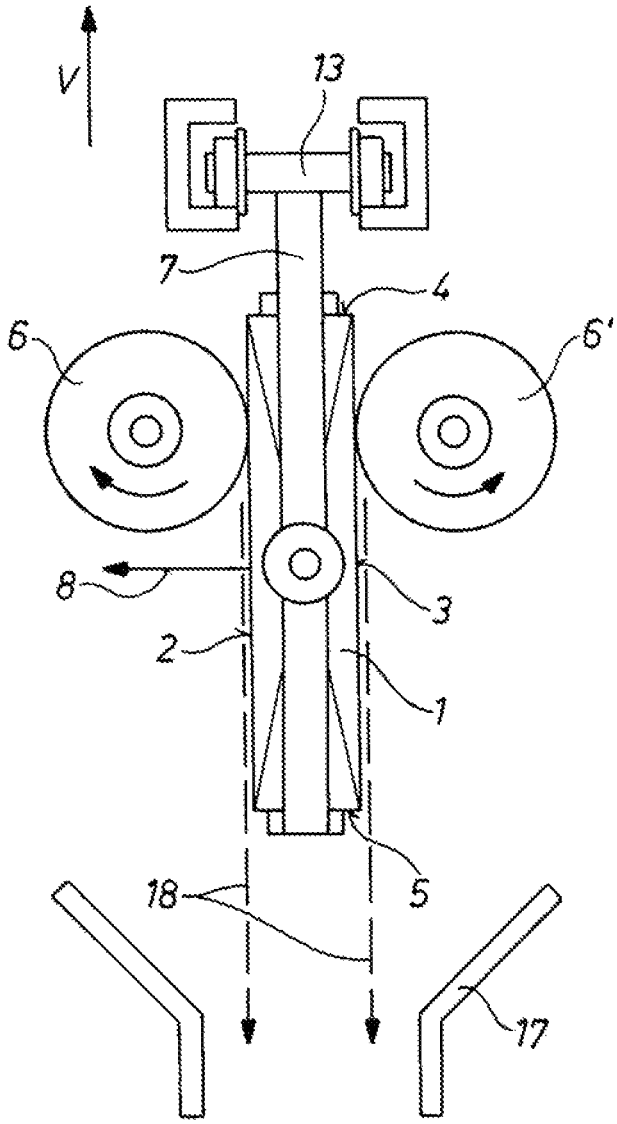
FIG. 5 diagrammatically shows an apparatus for grinding a continuously cast slab according to a third embodiment of the invention.

The concept according to the invention also comprises orienting the slab 1 during grinding such that the angle between the vertical V and the perpendicular 8 from the wide side face 2 of the slab 1 forms a right angle. This is shown in FIG. 5. The slab is thus here oriented vertically on edge. This has the special advantage that here the two wide side faces 2 and 3 can be ground simultaneously in a particularly simple manner, which renders possible a corresponding reduction of the time for the processing of the slab 1. For this purpose two grinding wheels 6 and 6' are provided that process the two faces 2 and 3 at the same time.

Otherwise, here—which is not mandatory, but preferred—the slab 1 is suspended, i.e. the seat 7 is embodied here as a frame that clamps the slab 1 on its upper side and lower side, i.e. on the narrow edge faces 4, 5, and holds it in the shown position. The grinding table 13 is accordingly arranged in the upper region of the apparatus. Of course, alternatively the slab 1 arranged in a clamping frame can also be placed with a narrow edge face on a grinding table in the shown manner and processed as explained above.

Figure 6:
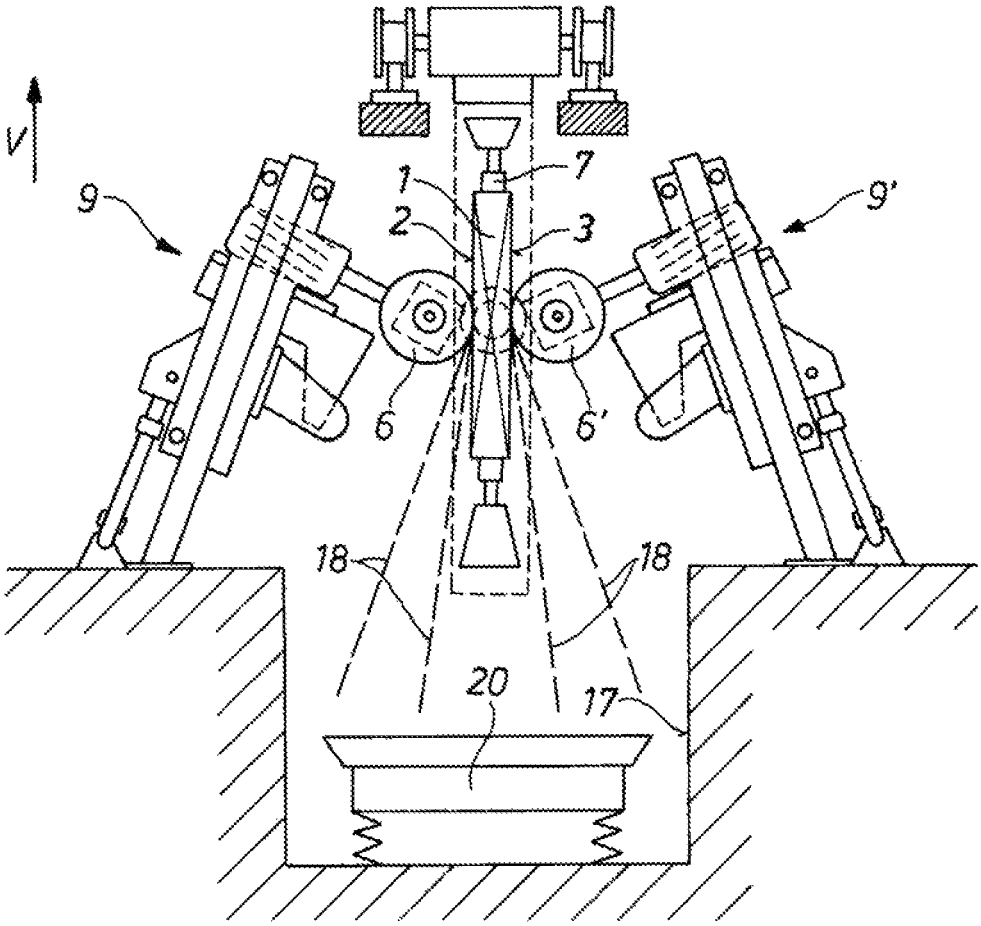
FIG. 6 shows an apparatus for grinding a continuously cast slab according to a fourth embodiment of the invention.

In addition to the diagrammatic representation according to FIG. 5, FIG. 6 shows a concrete embodiment of this concept.

Here two grinders 9 and 9' can be seen that operate two grinding wheels 6 and 6'. The grinders 9 and 9' are equipped with the required control elements (hydraulic piston-cylinder systems) in order to be able to guide the grinding wheels 6, 6' vertically along the wide side faces 2 and 3. In the chip collection box 17, here embodied as a trench, an oscillating conveyor trough 20 is arranged, with which the chips can be conveyed for disposal.

With vertical orientation of the slab 1, the chip flight 18 is optimized in that the chips are guided directly into the chip collection box 17 below the machine.

Compared to the conventional grinding of the slab, the processing times are reduced by more than half with the method explained, since not only the time for grinding the wide side face, but also the auxiliary times for turning the slab 1 are omitted.

There is also an advantage in terms of devices in that with a vertical orientation of the slab both grinders 9 and 9' can be mounted on a common frame or housing. Furthermore, inspection of the grinding result is simpler.

For shifting or reclamping the slab 1 for an optionally desired grinding of the narrow edge faces, the grinders 9 and 9' can be pivot or move laterally away from the slab.

The grinders are usually equipped with hot pressed grinding wheels 6. The drive power as well as the diameter and the width of the grinding wheel 6 are limited by its strength resulting from the production process of the wheel. Therefore grinding wheels with a diameter of 915 mm, for example, with a width of 150 mm, for example, are mostly used, which requires a motor drive power of, for example, 315 kW.

A higher throughput can theoretically be achieved by wider grinding wheels and higher motor drive powers, which, however, has limits—as has been said. Arbitrarily widening the grinding wheel is not possible due to the production process of the wheels and the strength of the binder for the abrasive particles.

The invention claimed is:

1. A method of grinding a continuously cast slab of rectangular cross section with two wide side faces lying opposite one another and two narrow edge faces lying opposite one another, the method comprising the steps of:

supporting the slab on a seat with the wide faces vertical;

subjecting at least the wide side faces to a surface treatment by at least one grinding tool pressed horizontally against the slab.

2. The method according to claim 1, wherein the two wide side faces of the continuously cast product lying opposite one another are ground simultaneously by respective grinding tools.

3. The method according to claim 2, wherein the continuously ground product is positioned with the wide faces vertical by a seat in the form of a holding frame during the grinding in a suspended manner.

4. The method according to claim 1, wherein the wide side face of the continuously cast product is at least twice as long as the narrow edge face of the continuously cast product.

5. An apparatus for grinding a continuously cast slab of rectangular cross section with two wide side faces lying opposite one another and two narrow edge faces, the apparatus comprising:

a seat holding the slab with the wide faces vertical;

at least one grinder with at least one grinding tool for grinding at least one of the wide side faces of the continuously cast product; and means for pressing the one grinder horizontally against the one side face.

6. The apparatus according to claim 5, wherein there are two of the grinders with respective grinding tools provided for simultaneously processing the two wide side faces of the continually cast product lying opposite one another, the means for pressing simultaneously oppositely pressing the two grinders against the slab horizontally.

7. The apparatus according to claim 5, wherein the seat comprises a holding frame with which the continually cast product can be positioned in a suspended manner.

8. A method of grinding a cast slab having a pair of wide, substantially planar, and opposite side faces and a pair of narrow opposite edge faces, the method comprising the steps of:

orienting the slab with the side and edge faces vertical;

pressing a grinding tool against one of the side faces; and relatively longitudinally displacing the grinding tool and the slab.

9. The method defined in claim 8 wherein the tool is a grinding wheel, the method comprising the step of:

rotating the wheel about a generally horizontal axis.

10. The method defined in claim 9, further comprising the step of:

rotating the wheel about the axis in such a direction as to project particles ground off the one side face downward.

11. The method defined in claim 10, further comprising the step of:

providing a receptacle below the slab for catching the particles.

12. The method defined in claim 8, the method comprising the step of:

pressing another grinding tool against the other side face of the slab so as simultaneously to grind both side faces during relative longitudinal reciprocation of the tool and slab.

13. The method defined in claim 12 wherein the slab is oriented by gripping the slab only at its edge edges.

14. The method defined in claim 8 wherein the tool and the slab are relative displaced by longitudinally reciprocating the slab, the method further comprising the step of:

transversely stepping the tool after each reciprocation of the slab.

* * * * *